US006938361B2

(12) United States Patent
Su

(10) Patent No.: US 6,938,361 B2
(45) Date of Patent: Sep. 6, 2005

(54) PIVOTAL COUNTER ASSEMBLY FOR A SHOE

(76) Inventor: Cheng-Wen Su, No. 26-1, An-Hsi Chuang, An-Hsi Li, Changhwa City, Changhwa Hsien (TW)

( * ) Notice: Subject to any disclaimer, the term of this patent is extended or adjusted under 35 U.S.C. 154(b) by 134 days.

(21) Appl. No.: 10/684,935

(22) Filed: Oct. 14, 2003

(65) Prior Publication Data

US 2005/0076540 A1 Apr. 14, 2005

(51) Int. Cl.[7] ..... A43B 21/00; A43B 23/28; A43B 3/26

(52) U.S. Cl. ..... 36/105; 36/58.6; 36/97

(58) Field of Search ..... 36/92, 97, 105, 36/58.6, 69, 68, 72 B, 114, 138, 117.8, 38

(56) References Cited

U.S. PATENT DOCUMENTS

| | | | | | |
|---|---|---|---|---|---|
| 2,452,649 | A | * | 11/1948 | Graves | 36/138 |
| 4,761,899 | A | * | 8/1988 | Marxer | 36/105 |
| 5,127,170 | A | * | 7/1992 | Messina | 36/105 |
| 5,184,410 | A | * | 2/1993 | Hamilton | 36/105 |
| 5,282,327 | A | * | 2/1994 | Ogle | 36/105 |
| 6,594,921 | B2 | * | 7/2003 | Laio et al. | 36/105 |
| 6,684,533 | B1 | * | 2/2004 | Su | 36/105 |
| 2005/0039348 | A1 | * | 2/2005 | Raluy et al. | 36/105 |

FOREIGN PATENT DOCUMENTS

| | | | | |
|---|---|---|---|---|
| WO | WO 92/03943 | A1 | * 3/1992 | A43B/11/00 |

* cited by examiner

*Primary Examiner*—Anthony Stashick
(74) *Attorney, Agent, or Firm*—Alan D. Kamrath; Nikolai & Mersereau P.A.

(57) ABSTRACT

A pivotal counter assembly for a shoe has a base, a pivot, a counter plate, a torsion spring, a push button, an engaging device and a biasing member. The pivot is pivotally mounted in the base with a pivot pin. The counter plate extends upward from the pivot. The torsion spring is mounted around the pivot pin to provide a recoil force to the pivot. The push button is slidably mounted in the base. The engaging device is mounted between the push button and the pivot to hold the counter plate at a desired position. The biasing member is mounted between the push button and the base to provide a restitution force to the push button. In such an arrangement, the user does not need to manually push the push button, and the use of the counter assembly is easy and convenient.

6 Claims, 4 Drawing Sheets

PIVOTAL COUNTER ASSEMBLY FOR A SHOE

BACKGROUND OF THE INVENTION

1. Field of the Invention

The present invention relates to a counter assembly, and more particularly to a pivotal counter assembly for a shoe.

2. Description of Related Art

A shoe has a counter portion to enclose the heel of a user who wears the shoe. In general, the counter portion is integrally formed on an upper of the shoe to make a continuous upper, which substantially includes a toe cup, a vamp and a counter portion. However, to put on or take off the shoe having a continuous upper with an integral counter portion is inconvenient. Therefore, a pivotal counter assembly is provided to enable the counter portion to be pivotally rotated, and the user can put on or take off the shoe conveniently.

A conventional pivotal counter assembly in accordance with the prior art substantially comprises a base, a counter plate and a positioning device. The base is embedded in a hole defined in the sole of the shoe. The counter plate is curved and is pivotally mounted on the base to serve as a counter portion of the upper of the shoe. The positioning device is mounted between the base and the counter plate to hold the counter plate in position. When the positioning device is released, the counter plate can be pivoted relative to the base. Accordingly, the user can put on or take off the shoe with the pivotal counter assembly.

However, at least one hand of a user is needed for releasing the positioning device of the conventional counter assembly, so the use of the conventional pivotal counter assembly is inconvenient.

To overcome the shortcomings, the present invention tends to provide a pivotal counter assembly to mitigate or obviate the aforementioned problems.

SUMMARY OF THE INVENTION

The main objective of the invention is to provide a pivotal counter assembly for a shoe and one that is convenient in use. The pivotal counter assembly has a base, a pivot, a counter plate, a torsion spring, a push button, an engaging device and a biasing member. The base has a top, a bottom, a rear, a cavity defined in the rear and multiple threaded holes defined in the bottom. The pivot is pivotally mounted in the cavity in the base with a pivot pin and has a top, an outer surface and a pivotal hole with an inner surface axially defined in the pivot. The counter plate has a curved cross section and extends upward from the top of the pivot. The torsion spring is mounted around the pivot pin and is received in the pivotal hole in the pivot. The torsion spring has two ends connected respectively to the base and the pivot to provide a recoil force to the pivot. The push button is slidably mounted in the cavity in the base. The push button has a proximal end extending into the cavity and corresponding to the pivot and a distal end extending out from the cavity. The engaging device is mounted between the proximal end of the push button and the outer surface of the pivot to keep the pivot from rotating relative to the base and to hold the counter plate at a desired position. The biasing member is mounted between the push button and the base to provide a restitution force to the push button. When the push button is pushed, the engaging device will be disengaged and the pivot with the counter plate can be pivoted relative to the base so as to open the counter assembly. Accordingly, it is not necessary for a user to manually push the push button, and the use of the counter assembly is easy and convenient.

Other objects, advantages and novel features of the invention will become more apparent from the following detailed description when taken in conjunction with the accompanying drawings.

DETAILED DESCRIPTION OF PREFERRED EMBODIMENT

Figure 1:
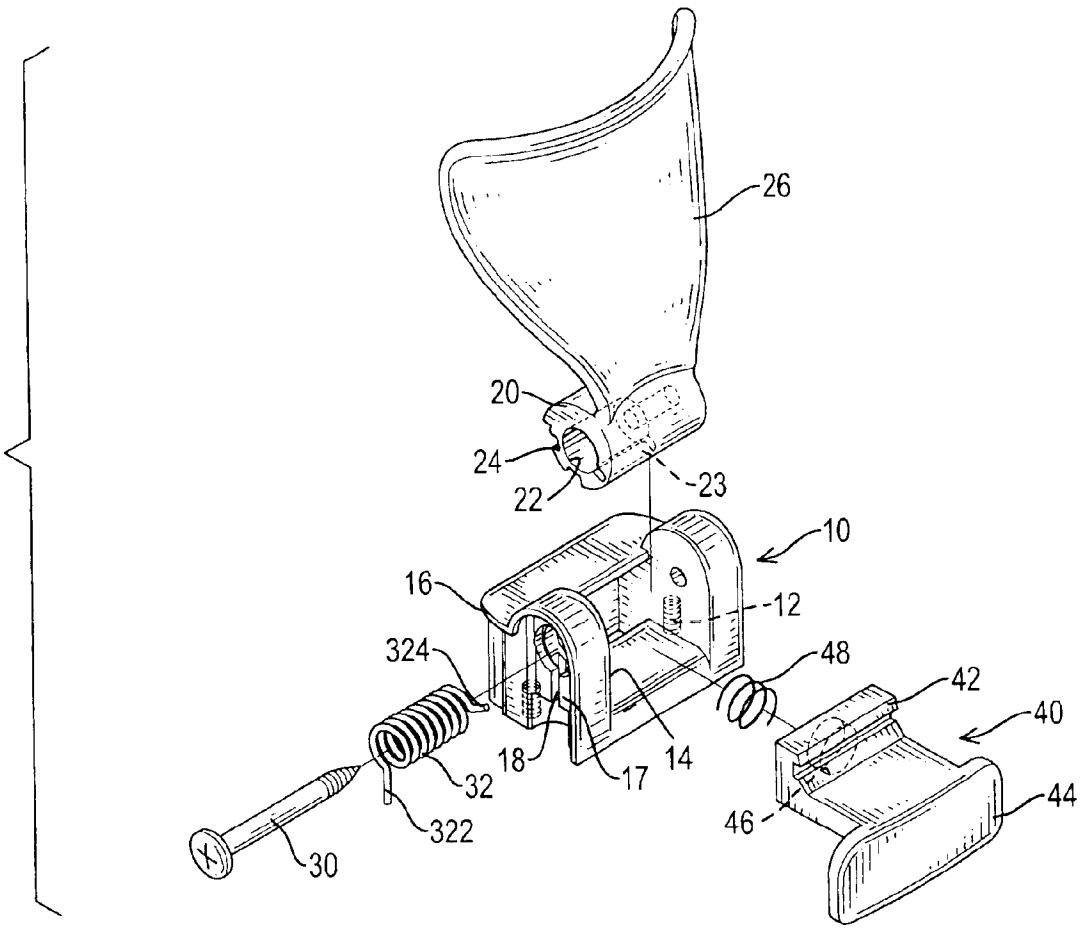
FIG. 1 is an exploded perspective view of a pivotal counter assembly in accordance with the present invention.
Figure 2:
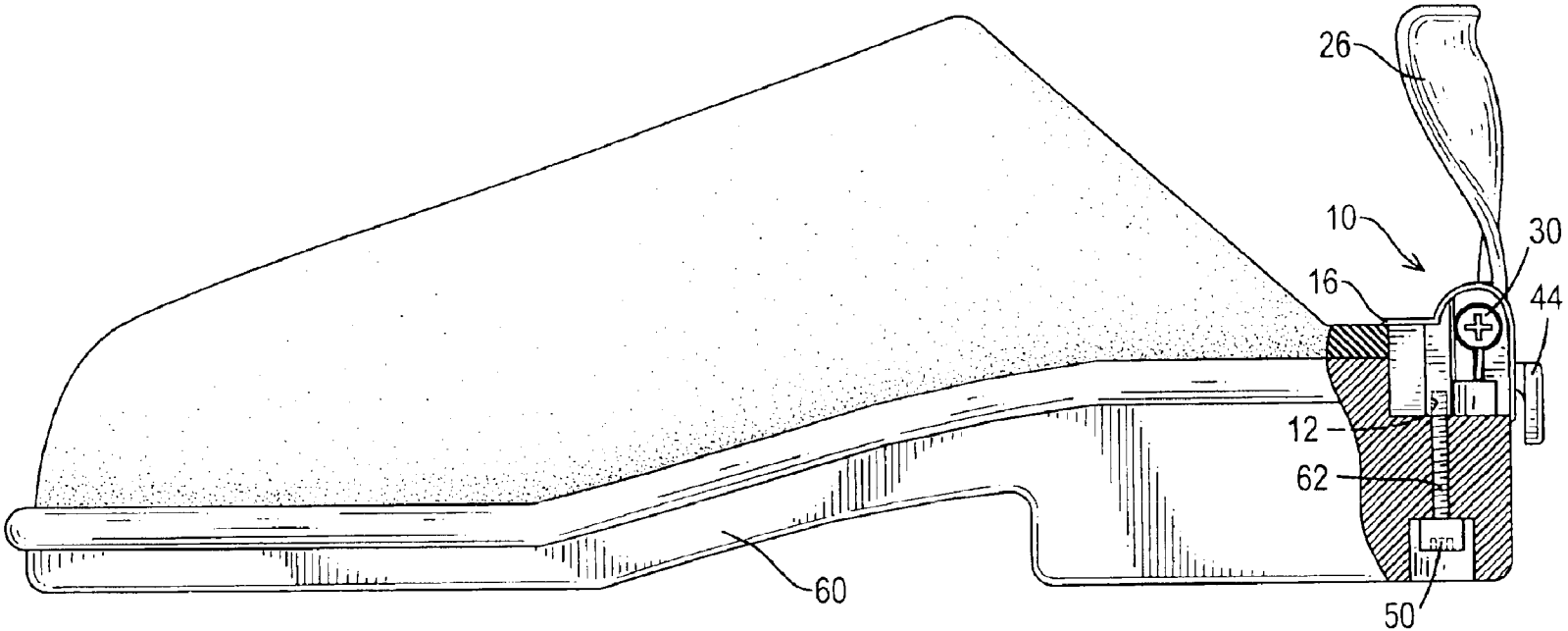
FIG. 2 is a side plan view in partial section of a shoe with the pivotal counter assembly in FIG. 1.

With reference to FIGS. 1 and 2, a pivotal counter assembly for a shoe in accordance with the present invention comprises a base (10), a pivot (20), a counter plate (26), a torsion spring (32), a push button (40), an engaging device (not numbered) and a biasing member (48). The base (10) is securely mounted on the sole of the shoe (60). The sole has a top and a recess (not numbered) defined in the top for receiving the base (10). The base (10) has a top, a bottom, a rear, a cavity (14), multiple threaded holes (12) and optionally a flange (16). The cavity (14) is defined in the rear. The threaded holes (12) are defined in the bottom. The sole has multiple through holes (62) respectively corresponding to the threaded holes (12) in the base (10). Multiple bolts (50) extend respectively through the through holes (62) in the sole and screw into the threaded holes (12) in the base (10) so as to securely mount the base (10) on the sole with the bolts (50). The optional flange (16) laterally extends along the top and the rear and abuts against the top of the sole along the periphery of the recess in the sole when the base (10) is received in the recess. With the arrangement of the flange (16), the gap between the base (10) and the recess is closed, and this can keep water from entering the recess and makes the appearance of the shoe with the pivotal counter assembly attractive.

The pivot (20) is pivotally mounted in the cavity (14) in the base (10) with a pivot pin (30). The pivot (20) has a top, an outer surface and a pivotal hole (22) with an inner surface axially defined in the pivot (20). In a specific embodiment, the pivot pin (30) is a screw extending into one side of the base (10) and through the pivot hole (22) in the pivot (20) and screwing into the other side of the base (10). In an alternative embodiment, the pivot pin is a rivet extending through the base (10) and the pivot hole (22) in the pivot (20) to pivotally mount the pivot (20) in the cavity (14) in the base (10).

The counter plate (26) has a curved cross section and extends upward from the top of the pivot (20) to serve as a counter portion on the shoe. In a specific embodiment, an outer layer (not shown) made of resilient material is coated on the counter plate (26) to improve the comfort of wearing the shoe.

The torsion spring (32) is mounted around the pivot pin (30) and is received in the pivotal hole (22) in the pivot (20).

The torsion spring (32) has two ends connected respectively to the base (10) and the pivot (20) to provide a recoil force to the pivot (20). In a specific embodiment, the torsion spring (32) has two legs (322,324) extending respectively from the two ends. The pivot (20) has a groove (23) longitudinally defined in the inner surface defining the pivotal hole (22), and the base (10) has two tabs (17) separate to each other to define a gap (18) between the tabs (17). The legs (322,324) on the torsion spring (32) are received respectively in the groove (23) in the pivot (20) and the gap (18) in the base (10). Accordingly, when then counter plate (26) is rotated relative to the base (10), the torsion spring (32) will be twisted to store a recoil force.

Figure 3:
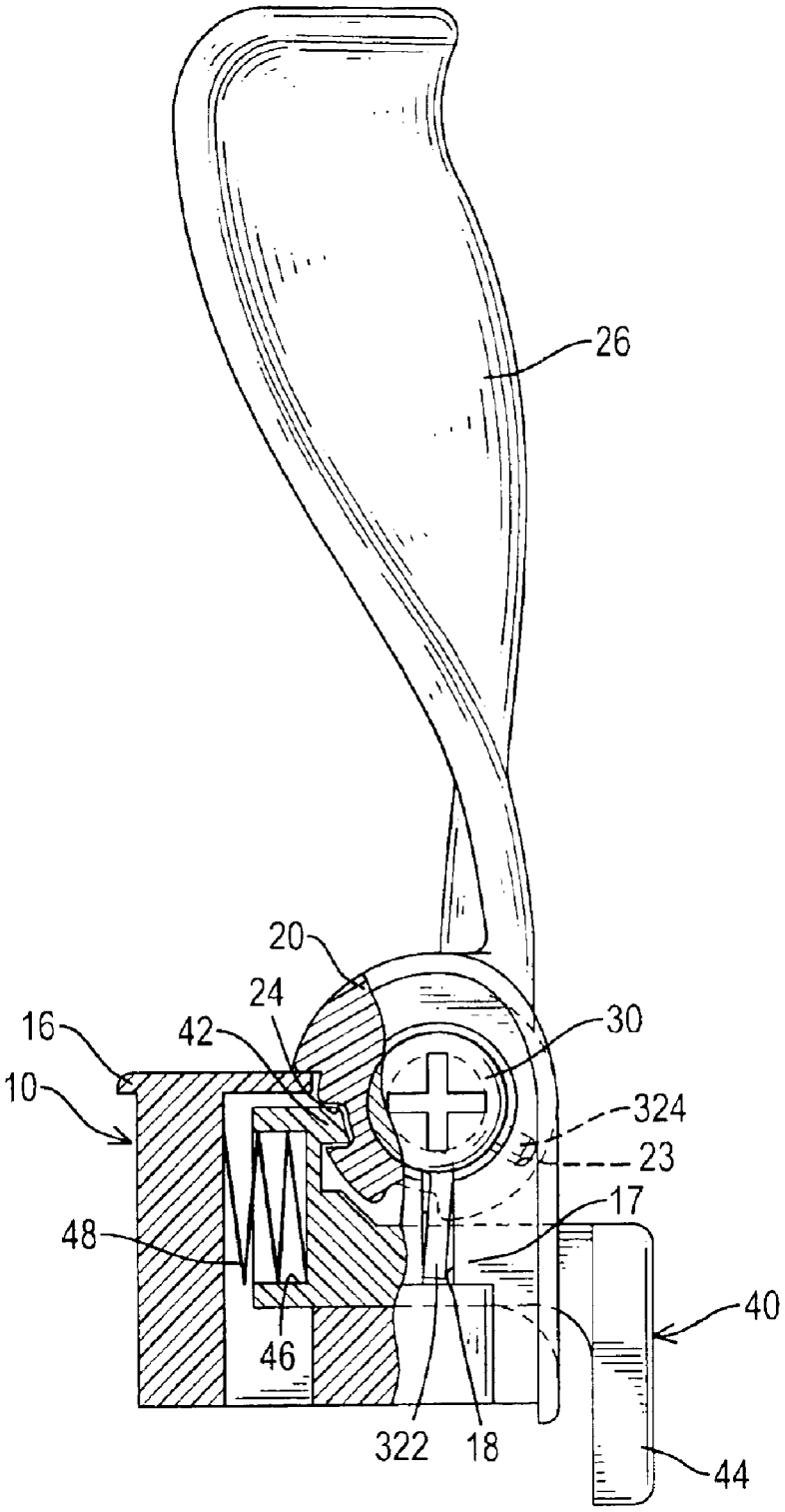
FIG. 3 is a side plan view in partial section of the pivotal counter assembly in FIG. 1 showing the counter plate in a vertical condition.

With further reference to FIG. 3, the push button (40) is slidably mounted in the cavity (14) in the base (10) and has a proximal end, a distal end and optionally a pushed plate (44). The proximal end extends into the cavity (14) and corresponds to the pivot (20). The distal end extends out from the cavity (14). The optional pushed plate (44) is vertically formed on and extends from the distal end.

The engaging device is mounted between the proximal end of the push button (40) and the outer surface of the pivot (20) to keep the pivot (20) from rotation relative to the base (10) and to hold the counter plate (26) at a desired position. In a specific embodiment, the engaging device comprises two engaging recesses (24) and an engaging tooth (42). The engaging recesses (24) are longitudinally defined in the outer surface of the pivot (20). The engaging tooth (42) is formed on the proximal end of the push button (40) and selectively engages with the one of the engaging recesses (24) in the pivot (20). With the engagement between the engaging tooth (42) and the corresponding engaging recess (24) in the pivot (20), the pivot (20) will be kept from rotation and held in place relative to the base (10). In an alternative embodiment, the engaging device comprises two engaging teeth formed on the outer periphery of the pivot (20) and an engaging recess defined in the proximal end of the push button (40) to selectively engage with one of the engaging teeth on the pivot.

The biasing member (48) is mounted between the push button (40) and the base (10) to provide a restitution force to the push button (40). In a specific embodiment, the push button (40) has a hole (46) defined in the proximal end for receiving one end of the biasing member (48).

Figure 4:
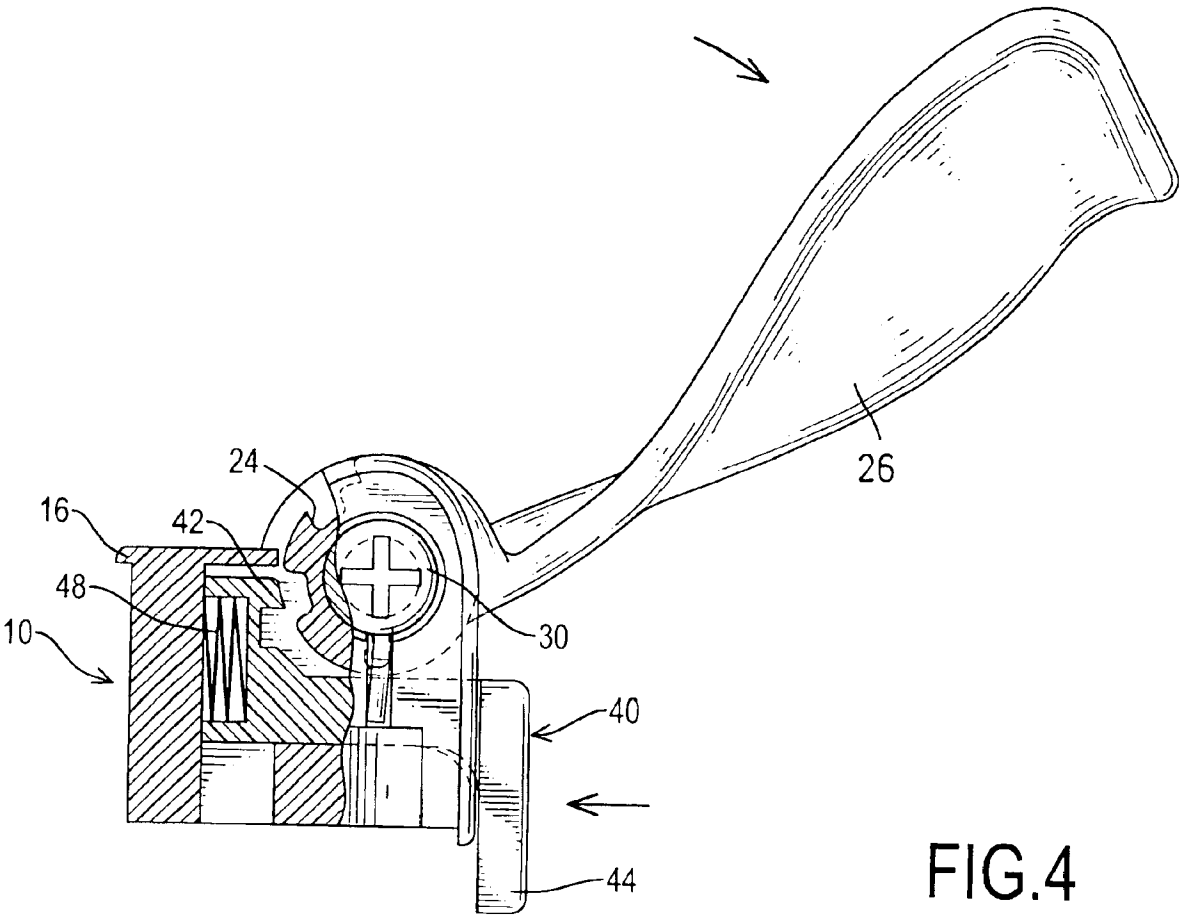
FIG. 4 is an operational side plan view in partial section of the pivotal counter assembly in FIG. 1 showing the counter plate in an open condition.

With reference to FIGS. 1 and 4, when the pushed plate (44) is pressed, the push button (40) will move relative to the base (10) and the engaging tooth (42) and the corresponding engaging recess (24) in the pivot (20) will be disengaged. Consequently, the counter plate (26) can be rotated relative to the base (10) to move the counter assembly to an open condition. When the pushed plate (44) is released, the biasing member (48) will push the push button (40) move backward and makes the engaging tooth (42) engage with the other engaging recess (24) in the pivot (20) to keep the counter plate (26) at the open condition.

When the pushed plate (44) is pressed and the engaging device is released again, the counter plate (26) will automatically rotate back to a vertical condition as shown in FIG. 3 with the recoil force provided by the torsion spring (32). Accordingly, to put on or to take off the shoe with the pivotal counter assembly is easy and convenient. To press the pushed plate (44), the pushed plate (44) can be pressed against a wall, the other foot of the user and so on. Therefore, it is not necessary for a user to manually operate the pivotal counter assembly. To use and to operate the pivotal counter assembly in accordance with the present invention is convenient.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A pivotal counter assembly for a shoe comprising:

a base having a top, a bottom, a rear, a cavity defined in the rear and multiple threaded holes defined in the bottom;

a pivot pivotally mounted in the cavity in the base with a pivot pin and having a top, an outer surface and a pivotal hole with an inner surface axially defined in the pivot;

a curved counter plate extending upward from the top of the pivot;

a torsion spring mounted around the pivot pin, received in the pivotal hole in the pivot and having two ends connected respectively to the base and the pivot to provide a recoil force to the pivot;

a push button slidably mounted in the cavity in the base and having a proximal end extending into the cavity and corresponding to the pivot and a distal end extending out from the cavity;

an engaging device mounted between the proximal end of the push button and the outer surface of the pivot to keep the pivot from rotating relative to the base and to hold the counter plate at a desired position; and a biasing member mounted between the push button and the base to provide a restitution force to the push button.

2. The pivotal counter assembly as claimed in claim 1, wherein the engaging device comprises two engaging recesses longitudinally defined in the outer surface of the pivot; and an engaging tooth formed on the proximal end of the push button and selectively engaging with the one of the engaging recesses in the pivot.

3. The pivotal counter assembly as claimed in claim 2, wherein the push button has a pushed plate vertically formed on and extending from the distal end.

4. The pivotal counter assembly as claimed in claim 2, wherein the push button has a hole defined in the proximal end for receiving one end of the biasing member.

5. The pivotal counter assembly as claimed in claim 1, wherein the pivot has a groove longitudinally defined in the inner surface of the pivotal hole;

the base has two tabs separate to each other to define a gap between the tabs; and the torsion spring has two legs extending respectively from the two ends and received respectively in the groove in the pivot and the gap in the base.

6. The pivotal counter assembly as claimed in claim 1, wherein the base further has a flange extending along the top and the rear.

* * * * *